US006006961A

United States Patent [19]

Wark

[11] Patent Number: 6,006,961

[45] **Date of Patent: *Dec. 28, 1999**

[54] GARDEN HOSE ADAPTER FOR FUEL CAN

[76] Inventor: Rickey E. Wark, 64 Trummel Ct., The Woodlands, Tex. 77381

[ * ] Notice: This patent is subject to a terminal disclaimer.

[21] Appl. No.: 09/211,788

[22] Filed: Dec. 15, 1998

Related U.S. Application Data

[63] Continuation of application No. 08/717,061, Sep. 20, 1996, Pat. No. 5,901,887.

[51] Int. Cl.[6] ..... B67D 3/00

[52] U.S. Cl. ..... 222/527; 222/1

[58] Field of Search ..... 222/527, 1

[56] References Cited

U.S. PATENT DOCUMENTS

| | | | |
|---|---|---|---|
| 1,563,609 | 12/1925 | Zerk | 222/527 X |
| 2,556,627 | 6/1951 | Miksis | 222/527 X |
| 4,548,344 | 10/1985 | Hestehave et al. | 222/527 X |
| 5,090,602 | 2/1992 | Link | 222/527 |
| 5,590,819 | 1/1997 | Armstrong | 222/609 |

*Primary Examiner*—Gregory L. Huson
*Attorney, Agent, or Firm*—Young & Basile, P.C.

[57] ABSTRACT

An improved dispensing system for gasoline cans, comprising a hose adapter which replaces at least the typical spout and sealing disk associated with the gasoline can cap. The hose adapter is designed to accept common garden hose couplings, such that an ordinary piece of garden hose can be securely attached to the adapter and then cut to length for convenient pouring from any distance. In a first embodiment the hose adapter operates with the original cap. In a second embodiment the hose adapter has a built-in cap portion, and replaces the original cap.

8 Claims, 2 Drawing Sheets

GARDEN HOSE ADAPTER FOR FUEL CAN

This application is a continuation of Ser. No. 08/717,061 filed Sep. 20, 1996 now U.S. Pat. No. 5,901,887.

FIELD OF THE INVENTION

This invention is generally in the field of caps and closures for liquid containers, and more specifically spout-type closures for gasoline cans.

BACKGROUND OF THE INVENTION

Many gasoline cans sold today include a short spout which can be threaded onto the can in place of the cap, or in conjunction with a cap, to help pour gasoline from the can in a controlled manner. Many such cans include a short spout which can be turned upside down and stored inside the can, held in place by the cap. The standard spout-retaining cap typically includes a sealing disk which is removed so that the spout can be reversed and extended through the cap for pouring. There are a number of problems with these prior art cap/spout arrangements.

A short spout, coupled with a large, heavy can, is difficult to maneuver and hold for pouring. It is often necessary to hold a can containing several gallons of gasoline in some awkward, difficult-to-maintain position in order to keep the spout in the filler pipe of a fuel tank on a vehicle such as a boat, airplane or snowmobile.

Spouts which are stored inside the can and held in place by the cap are often covered with gasoline when removed and reversed for pouring, which is unpleasant for the user's hands and clothing.

The prior art spout arrangements have a tendency to leak as the tilt of the can approaches vertical. Yet another difficulty lies in controlling the flow of gasoline through the short spout, which dispenses gasoline immediately when the can is tilted.

One prior art attempt to improve on the standard cap and spout arrangement is disclosed in U.S. Pat. No. 5,419,467. This device is a combined cap and spout with a twist to open/twist to close mechanism for fine control over the flow of gasoline. This device is trademarked commercially as the Spill Saver® by Flotool International. The Spill Saver® spout consists of several sizes of spout adapter which replace the cap on the gasoline can. The adapters are internally threaded on their lower end to be screwed onto the threads on the mouth of the can, and are externally threaded on an upper cylindrical coupling to accept the spout mechanism. The spout mechanism is a twopiece, twist-to-open/close unit with an internal twist valve selectively opening and closing flow to an upper open end comprising a smooth, cylindrical plug or stem which receives a short, flexible piece of spout in a sliding friction fit. The spout is closed at its free end with a simple press-in cap retained on the spout with a flexible keeper strap.

The Spill Saver® spout is primarily designed to provide twist-controlled pouring. It leaves several of the above-mentioned problems unsolved. For example, it uses a short spout similar to the prior art. It apparently is not sufficiently leak- and vapor-tight to replace the original gas can cap for long term storage; in fact, the directions on commercial packaging say "remove spout when storing and replace with original cap". And because it cannot be left on the gas can for storage, the Spill Saver® spout requires multiple spout adapters to match different cans.

SUMMARY OF THE INVENTION

The present invention solves the foregoing problems by replacing the original spout with a gas cap hose adapter capable of accepting ordinary garden hose couplings in fluid-tight manner. The inventive adapter can additionally be securely sealed to close the can without removing the adapter from the can.

The gas cap hose adapter of the present invention uses the original cap or has a cap-like body sized to mate with the mouth of a gas can in a secure, fluid-and vapor-tight manner, preferably with a threaded connection. The upper end of the adapter comprises a plug-like, externally threaded hose connector adapted to matingly receive standard garden hose couplings. A length of garden hose can then be cut to any desired length and quickly mated with the hose adapter to fill a tank at virtually any distance from the can. When the hose is removed the adapter preferably remains on the can and is sealed with a standard garden hose cap.

The threaded end of the adapter also provides a reasonably secure friction fit with ordinary, non-coupled tubing with suitable inner diameter and flexibility.

In a first embodiment the adapter comprises an insert with a sealed shoulder or flange which fits inside the gas can cap in place of the original self-storing spout and sealing disk. In a second embodiment the threaded adapter is formed with an integral cap portion to form a one-piece unit which completely replaces the original cap and any original spout structure.

Further features and structural details of the invention are set forth in the following description of the illustrated embodiments.

DETAILED DESCRIPTION OF THE ILLUSTRATED EMBODIMENTS

Figure 1:
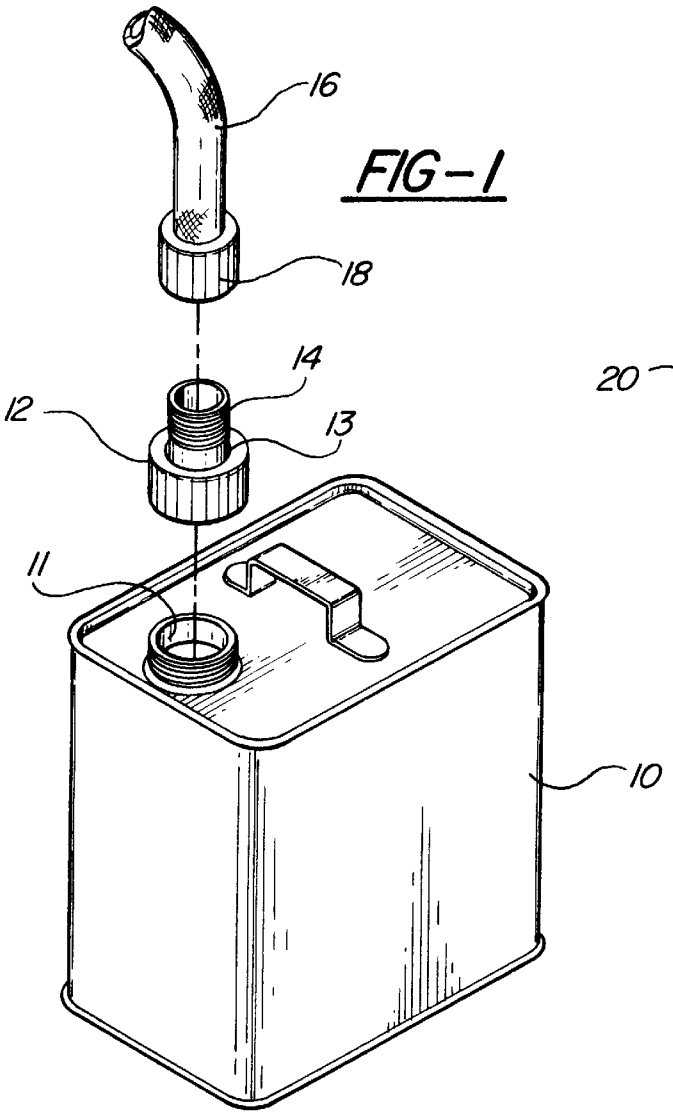
FIG. 1 is an exploded front perspective view of a standard gasoline can using a hose adapter according to the present invention.

Referring to FIG. 1, a standard gas can 10 is illustrated with a threaded mouth 11 and the can's original threaded cap 12. Cap 12 is hollow with a circular opening 13 in its upper surface. As will be apparent to those skilled in the art, opening 13 allows a conventional spout (not shown) to be fastened between cap 12 and mouth 11 with the spout extending through opening 13 in the cap. Such prior art spouts can typically be reversed for storage inside the can by inserting the spout through mouth 11 with an end shoulder resting on the mouth, and threading cap 12 thereover. In such prior art arrangements the cap is typically provided with an additional sealing disk (not shown) which fits between the spout's shoulder and the inside upper surface of cap 12 to close the can. This sealing disk is removed when the spout is taken out of the can and reversed through the cap for pouring.

Gas can 10 and cap 12 are typically made from sheet metal, plastic, or combinations thereof. The adapter invention described below can likewise comprise metal or plastic, whichever best mates with the can and any associated cap structure used with the adapter.

Figure 2:
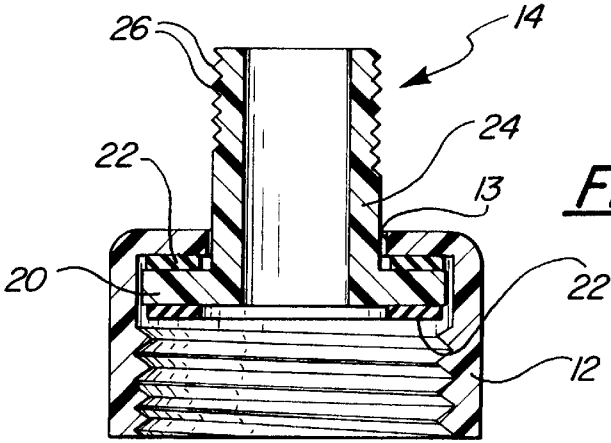
FIG. 2 is a side section view of a gas can cap with an insert-style hose adapter according to the present invention.

A first embodiment of the present invention is illustrated in FIG. 2 as an adapter 14 which replaces the prior art spout and sealing disk, and mates with original cap 12 to allow the connection of ordinary garden hose 16. In the embodiment of FIG. 2, adapter 14 comprises a disk-shaped lower flange or shoulder 20 having a diameter greater than that of opening 13 in cap 12, and preferably approximating the inside diameter of the cap. Adapter shoulder 20 is provided on its upper and lower surfaces with circular gaskets 22 to provide a fluid- and vapor-tight seal between both the adapter and the cap and the adapter and mouth 11 of the gas can. Adapter 14 includes a cylindrical plug portion 24 integral with shoulder 20 and extending through opening 13 in gas cap 12 as shown to form a fluid-dispensing pathway. Adapter plug 24 is provided on its upper end with threads 26; the diameter of plug 24 and the pitch of threads 26 allow ordinary garden hose couplings to be threadably mated to the adapter.

Those skilled in the art will recognize that garden hose threaded couplings are indeed standardized in the industry. In fact, no matter what size the garden hose, the various threaded male and female connectors will mate. Plastic and brass connectors will typically mate. Connectors from different manufacturers will mate. A call to the L. R. Nelson Corporation, 7719 North Pioneer Lane, Peoria, Ill. 61615 confirmed that "standard hose coupling" is a term of art in the industry for lawn and garden hoses in terms of male and female thread compatibility and sizing. For example, hands-on experimentation has shown that a brass hose end cap from L. R. Nelson Corporation will mate with the threaded end of a 2905 plastic snap connect from L. R. Nelson Corporation, as well as a brass quick connect N-109C from L. R. Nelson Corporation. The plastic hose end cap N-800B from L. R. Nelson Corporation will mate with the Nelson® N-109C brass quick connect and the Nelson 2905 snap connect. The Nelson® N-109C brass quick connect will mate with an HWI Do It® Best 7409600/M1-12-72 plastic coupler and a Gardena® 36919 plastic outlet end connector. The Gardena® 36919 plastic outlet end connector in turn mated with the Nelson 2905 plastic snap connect. Accordingly, the terms "standard" and "ordinary" as used herein for lawn and garden hose couplings encompasses all interchangeably-mated hose couplings which are commercially available, whether brass, some other metal, or plastic.

The inventive adapter disclosed herein is specifically sized at plug portion 24 and threads 26 to accept all female standard hose couplings on the market. It will also be apparent to those skilled in the art that, while a male plug 24 is disclosed in the illustrated embodiments, it would also be possible to provide a female standard hose coupling arrangement on the upper end of plug 24 to accept standard male hose couplings.

Referring back to FIG. 1, an ordinary garden hose 16 can be attached to inventive adapter 14 merely by threading standard garden hose coupling 18 to the threads 26 on adapter plug 24 extending through the gas cap. This garden hose coupling is more secure and more fluid-tight than prior art spout arrangements.

Figure 4:
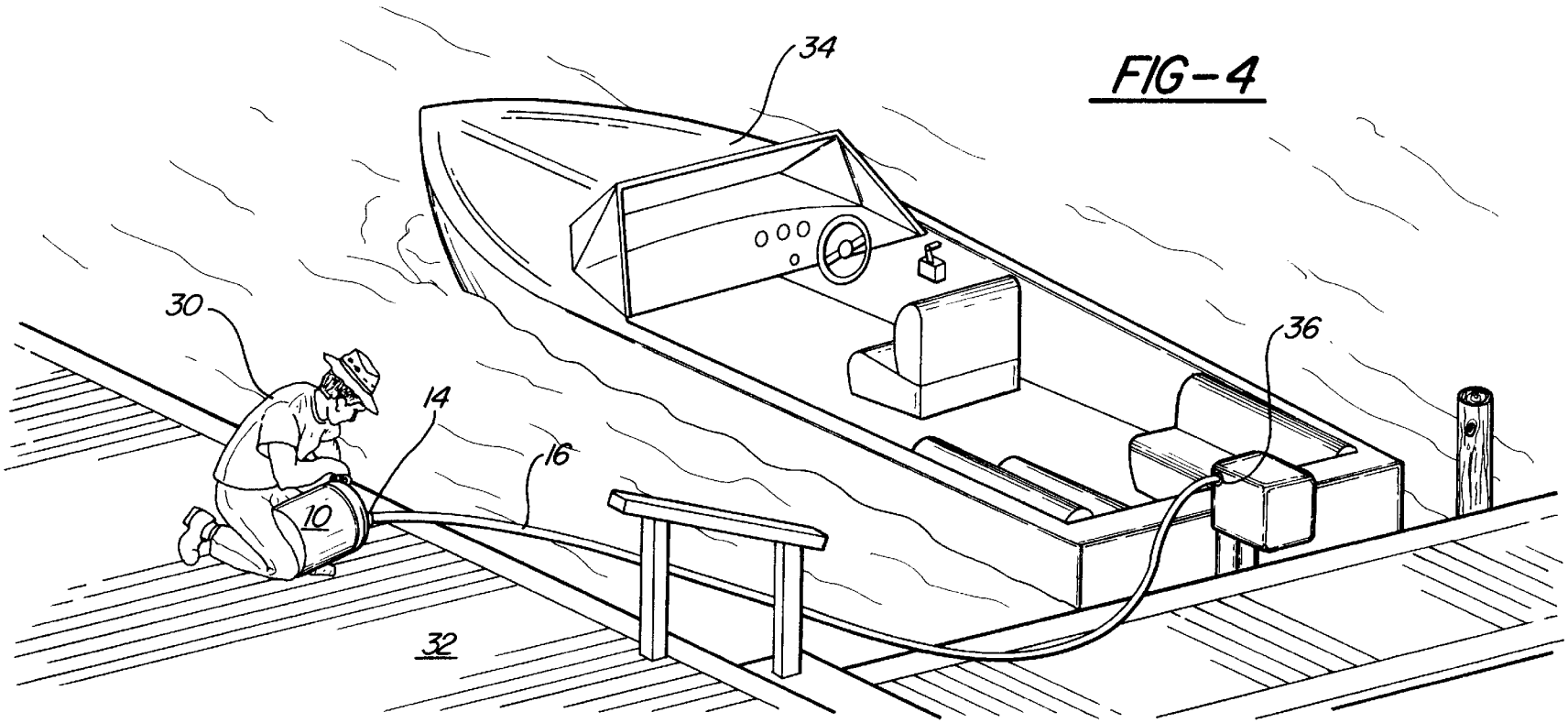
FIG. 4 illustrates a gas can hose adapter according to the invention being used to fill a motorboat tank from a distance.

As a further advantage, the free end of garden hose 16 can be cut to virtually any desired length, giving the user options to pour gasoline from a convenient location to fuel tanks in awkward or remote locations. One example of such an advantageous use of the invention is illustrated in FIG. 4, in which a man 30 is confronted with the problem of refueling a boat 34 moored to a dock higher than the boat. It would be extremely awkward to attempt to refuel the boat from the dock with the typical gasoline can and spout arrangement. It is also inconvenient to lug a full can of gasoline aboard the boat for refueling. Using the present invention, the person refueling boat 34 can stay safely and conveniently on dock 32 with the gasoline can 10 after having attached hose 16 to adapter 14 on the can dockside, and further after having inserted the long length of hose into the filler pipe 36 boatside while leaving the can on the dock. He can subsequently return to the dock unencumbered, and simply empty the can through the hose into the tank from a distance.

It will be appreciated that the inventive adapter's ability to couple with standard garden hose couplings is a distinct advantage in terms of convenience, seal quality, and accessibility of hose and hose accessories (which are commonly available at hardware stores) . In addition to those described aboe, one such hose accessory useful for dispensing gasoline from garden hose 16 in a controlled manner is the known and commercially available push-lock type connector with a built in flow switch.

Figure 3:
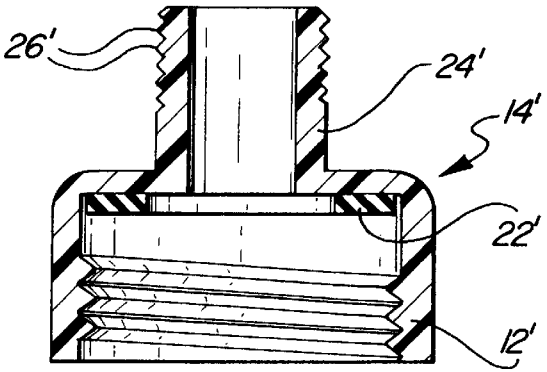
FIG. 3 is an alternate embodiment of the invention in which the adapter is formed with an integral cap portion.

Referring now to FIG. 3, an alternate embodiment of the inventive gas cap hose adapter is shown at 14', comprising an integral cap portion 12' and threaded plug portion 24'. Alternate adapter 14' completely replaces the original cap and spout structure on the gasoline can in favor of an integrated arrangement. Like the insert-style adapter 14 of FIG. 2, adapter 14' includes a gasket seal 22', although only a single gasket is required to provide a seal between the adapter and the can. Adapter 14' is simply threaded directly onto mouth 11 of gas can 10, and garden hose 16 is attached by coupling 18 as described with reference to FIG. 1.

The threaded upper end of adapter plug 24 (24') can also accommodate plain hose in a friction fit with the threads 26 (26'), provided the plain hose has an inner diameter and overall flexibility sufficient to provide a sealing friction fit over plug 24. However, the standard garden hose coupling is preferred for ease of installation, strength of the seal between the adapter and the hose, and readily-available accessories for the free end of the hose, as described above.

When not in use, adapter 14 can be closed with a commonly available garden hose cap. Again, the garden hose couplings between adapter and hose and adapter and hose cap are superior to prior art cap/spout connections, due to the high quality materials, better gaskets, and precise threading required for the pressurized environment of garden hoses. The high-count, angular threads, in particular, are far superior to the rounded, widely-spaced threads on prior art caps and spouts.

It will be understood by those skilled in the art that the foregoing illustrated embodiments of the invention are exemplary in nature, and that minor changes and modifications to the size, shape or dimensions of the inventive adapter system are possible for those skilled in the art without departing from the scope and spirit of the invention as defined in the following claims. For example, while the plug portion 24 of the adapter requires an upper end sized and threaded to fit common garden hose couplings, it will be apparent to those skilled in the art that the adapter can be sized to fit virtually any gasoline can 10 or gasoline cap 12.

I accordingly claim:

1. A fuel can cap and pour adapter system, comprising:

a threaded fuel can cap having internal threads adapted for sealing installation with threads on a mouth of a fuel can;

an adapter extending from the fuel can cap to provide a fluid dispensing pathway through the fuel can cap;

a seal associated with the adapter and the fuel can cap, the seal being adapted to provide a seal against the mouth of a fuel can around the fluid dispensing pathway;

wherein, the adapter comprises a plug portion extending from the fuel can cap, the plug portion comprising a threaded hose connector with standard garden hose threads adapted to threadably and sealably mate with a standard garden hose coupling to provide an attachment for a garden hose.

2. The system of claim 1, wherein the adapter and the fuel can cap are integral and are capable of being installed on a mouth of a fuel can as a single unit.

3. The system of claim 1, wherein the adapter is formed separately from the fuel can cap, the fuel can cap includes an opening and the adapter is adapted to be inserted in the fuel can cap with the plug portion extending through the opening such that the adapter is secured between the fuel can cap and the mouth of a fuel can when the fuel can cap is installed on a fuel can.

4. The system of claim 3, wherein the adapter includes a shoulder sized to fit within the fuel can cap and to seat against a mouth of a fuel can, the adapter shoulder including upper and lower gaskets to provide a fluid and vapor tight seal with both the fuel can cap and a mouth of a fuel can.

5. The system of claim 1, wherein the standard garden hose threads on the adapter plug portion comprise male threads adapted to threadably mate with a standard female garden hose coupling.

6. The system of claim 4, wherein the standard garden hose threads on the adapter plug portion comprise female threads adapted to threadably mate with a standard male garden hose coupling.

7. A garden hose adapter for a fuel can cap, comprising a plug portion adapted to extend through an opening in the fuel can cap to define a fluid dispensing pathway through the cap, the plug portion comprising a threaded hose connector with standard garden hose threads adapted to threadably and sealably mate with a standard garden hose coupling to provide an attachment for a garden hose, and seal means adapted to seal the adapter with respect to the fuel can cap, such that fuel cannot leak between the fuel can cap and the adapter.

8. A method for adapting a cap on a fuel can to pour fuel through a garden hose, comprising:

providing the cap with a plug portion extending from the cap to define a fluid dispensing pathway through the cap;

providing the plug portion with standard garden hose threads adapted to threadably and sealably mate with a standard garden hose coupling; and, attaching a length of garden hose to the standard garden hose threads on the plug portion via a standard garden hose coupling.

* * * * *